United States Patent [19]

Gueraud

[11] Patent Number: 4,484,447

[45] Date of Patent: Nov. 27, 1984

[54] TURBINE GENERATOR UNIT INSTALLATION

[75] Inventor: Roger Gueraud, Maisons Alfort, France

[73] Assignee: Electricite de France (Service National) French National Service, Paris, France

[21] Appl. No.: 468,649

[22] Filed: Feb. 22, 1983

[30] Foreign Application Priority Data

Feb. 23, 1982 [FR] France ..... 82 02929

[51] Int. Cl.[3] ..... F01B 31/06

[52] U.S. Cl. ..... 60/687; 60/685; 165/69

[58] Field of Search ..... 60/685, 687, 690, 692; 165/67, 68, 69

[56] References Cited

FOREIGN PATENT DOCUMENTS

| | | |
|---|---|---|
| 4392 | 10/1979 | European Pat. Off. . |
| 1812487 | 8/1970 | Fed. Rep. of Germany . |
| 2109432 | 5/1972 | France . |
| 2120382 | 8/1972 | France . |
| 418362 | 2/1967 | Switzerland . |

*Primary Examiner*—Stephen F. Husar

*Attorney, Agent, or Firm*—Perry Carvellas

[57] ABSTRACT

A turbine generator unit comprises a turbine (1) and condenser (2) with flexible joint (33) between them. A table (4) supporting the turbine generator unit rests on springs (47). In conjunction with a baseplate (7) supporting the condenser (2) and supported on springs (67), it forms a cradle. The table (4) and baseplate (7) are linked together by means of columns (47).

1 Claim, 1 Drawing Figure

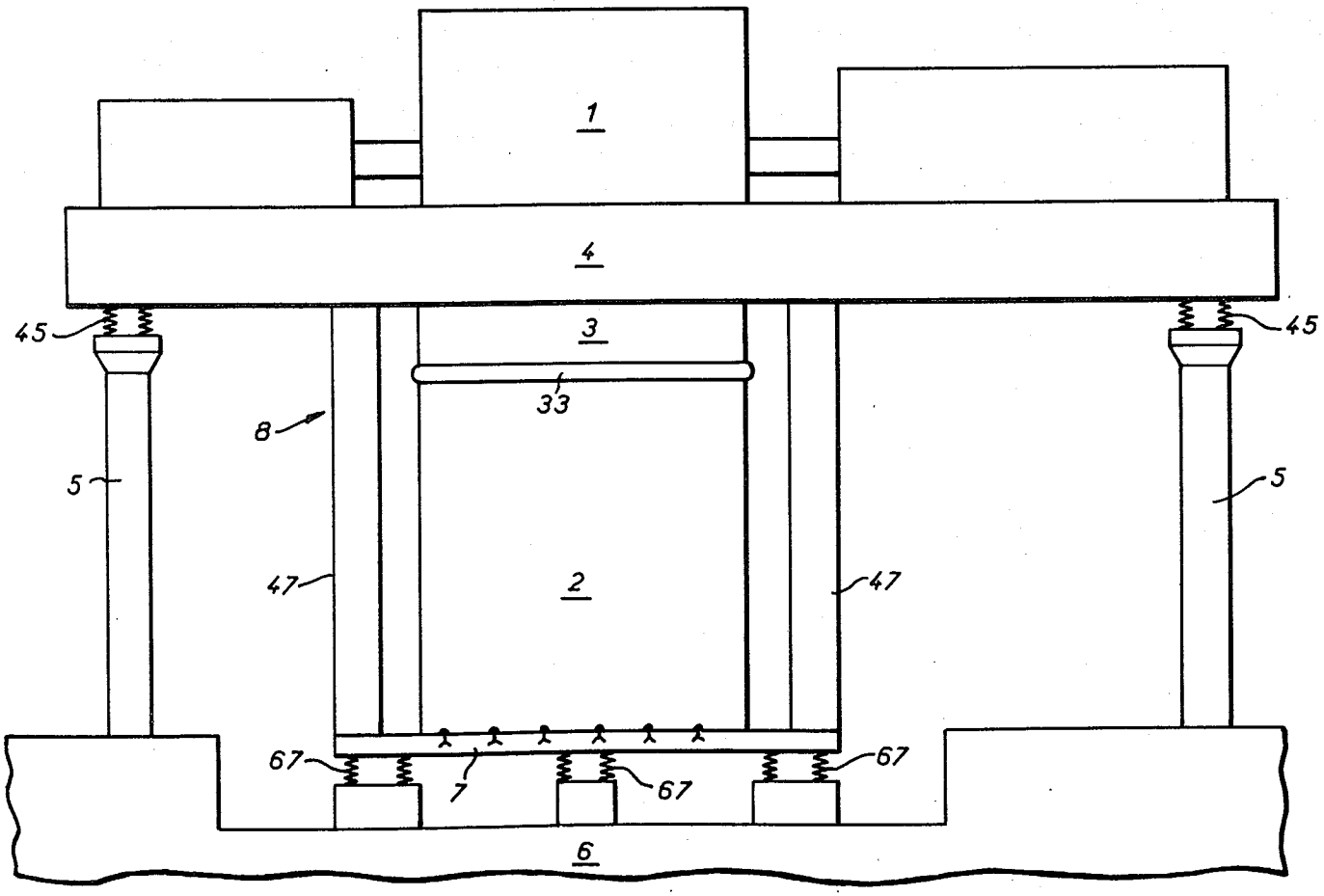
45
5
47
67
1
4
3
33
2
67
6
7
8
47
67
5
45

TURBINE GENERATOR UNIT INSTALLATION

BACKGROUND OF THE INVENTION

1. Field of the Invention

The present invention concerns turbine generator units particularly but not exclusively intended for the production of electricity in thermal or nuclear power stations, especially in locations subject to subsidence, and it is more particularly concerned with the installation of the turbines and condensers which such units comprise.

2. Description of the Prior Art

Turbine generator units of this kind comprise an elevated part or table to which is fixed the body of the low-pressure turbine. This table is supported by columns resting on a foundation slab, the condenser being supported beneath the turbine and coupled to it by a connecting sleeve.

There exist a number of turbine generator unit installations which differ from one another in terms of how the condenser is coupled to the turbine, to the table and to the foundation slab.

In the so-called "suspended condenser" arrangement, the condenser is mounted on springs and coupled to the turbine by a rigid connecting sleeve welded to their respective outer jackets. This arrangement, which is the conventional one in Europe, protects the table from the effect of atmospheric pressure when the condenser is evacuated. However, it has the disadvantage of transmitting to the turbine body unwanted loads resulting from variations in the quantity of water in the condenser and variations in the spring reaction forces associated with expansion of the condenser body.

A second so-called "seated condenser" arrangement consists in placing the condenser on the foundation slab and providing an airtight flexible joint in the connecting sleeve welded to the turbine and to the condenser. The latter is thus mechanically decoupled from the turbine, which is then not affected by thermal expansion of and variations in the quantity of water in the condenser. However, it is then the foundation slab which has to withstand the full atmospheric pressure loading when the condenser is evacuated, and this loading is typically substantially the same as the total weight of the turbine generator unit.

The tables of turbine generator units are sometimes mounted elastically on their supports by means of springs, in order to minimize dynamic stresses in the ground, to avoid the transmission of vibration and noise to surrounding structures, and to avoid unwanted subsidence of the ground.

A third arrangement, disclosed in French Pat. No. 70 37372 combines the advantages of the previous two arrangements. It consists in supporting the condenser partially on the foundation slab using springs and partially on the table using mechanical linking means; as in the second arrangement, the connecting sleeve incorporates a flexible joint. This arrangement provides for decoupling the turbine from the condenser, so that it is not subject to the consequences of loads to which the condenser is subjected, while not subjecting the foundation slab to the atmospheric pressure loading when the condenser is evacuated.

This third arrangement has a disadvantage, and this applies also to the first arrangement, in that it does not provide for the exceptional loadings to which the condenser may be subject during testing. Specifically, prior to commissioning a "hydraulic test" is carried out to test the fluid tightness of the condenser tubes, by filling with water the space normally filled with steam. The resulting exceptional loading is not generally taken into account in designing the turbine skirt or condenser wall. It is therefore necessary to fit wedges or adjustable abutments under the condenser for the duration of the test. This involves the services of skilled maintenance personnel if major damage through mis-operation is to be avoided.

The objective of the present invention is to retain the advantages of the already known arrangements while reducing the risk of mis-operation and its consequences.

SUMMARY OF THE INVENTION

The present invention consists in a turbine generator unit installation comprising a turbine and a condenser, mounted on an assembly comprising a foundation slab, a table to which said turbine and said condenser are rigidly attached, first elastic means supporting said table on said foundation slab, a sleeve coupling said condenser to said turbine, an airtight flexible joint in said sleeve, second elastic means coupling said condenser to said foundation slab, a baseplate supporting said condenser and supported on said second elastic means, and columns coupling said baseplate to said table, whereby said baseplate and said table together constitute a support cradle for said installation.

Other objects and advantages will appear from the following description of an example of the invention, when considered in connection with the accompanying drawing, and the novel features will be particularly pointed out in the appended claims.

BRIEF DESCRIPTION OF THE DRAWING

The accompanying drawing is a side view in elevation of a turbine generator unit installation in accordance with the invention.

DESCRIPTION OF THE PREFERRED EMBODIMENT

This installation comprises a turbine 1 and a condenser 2 coupled by welding, for example, by a connecting sleeve 3; turbine 1 and condenser 2 are mechanically decoupled by an airtight flexible joint 33 across sleeve 3. Turbine 1 is rigidly attached to table 4 which is formed, for example, by girders or longitudinal beams and which is supported, through the intermediary of first elastic means 45, on columns 5 supported on a foundation slab 6. Condenser 2 is attached to a baseplate 7 which is rigidly attached to table 4 by mechanical linking means 47 such as columns of reinforced concrete or steel. Baseplate 7 is supported on foundation slab 6 by second elastic means 67. Unlike the third kind of arrangement previously described, the condenser is thus not directly supported by these elastic means. Table 4, baseplate 7 and mechanical linking means 47 together constitute a cradle for the turbine generator unit consisting of turbine 1 and condenser 2, the whole assembly being elastically supported by foundation slab 6, which prevents any transmission of vibration from turbine 1 or condenser 2 into the ground during testing or operation.

The loads transmitted by cradle 8 to springs 67 are such that the loads due to variations in the quantity of water in condenser 2 represent only a small percentage of the total. The stiffness of springs 67 is naturally greater than would be the case with springs supporting only the condenser. This stiffness provides for overcoming deformation at the level of the shaft line of the turbine generator unit. Another advantage of the invention is that the configuration is that of the conventional "seated condenser" arrangement, so that the condenser manufacturer does not need to modify the production methods with which he is familiar.

It will be understood that various changes in the details, materials and arrangements of parts, which have been herein described and illustrated in order to explain the nature of the invention, may be made by those skilled in the art within the principle and scope of the invention as expressed in the appended claim.

It is claimed:

1. A turbine generator unit arrangement comprising a turbine and a condenser, a sleeve coupling said condenser to said turbine and including an airtight flexible joint, a table, said turbine being rigidly attached to said table, a foundation slab, first resilient means supporting said table on said foundation slab, said condenser being rigidly attached to a baseplate, second resilient means supporting said baseplate on said foundation slab, and columns rigidly connecting said table to said baseplate, such that said table, columns, and baseplate together define a cradle assembly resiliently mounted on said foundation slab.

* * * * *